313-414 SR
10/19/76 OR 3,987,328

United States Patent [19]
Yoshida et al.
[11] 3,987,328
[45] Oct. 19, 1976

[54] IN-LINE TYPE ELECTRON GUN ASSEMBLY FOR USE IN MULTI-BEAM TYPE COLOR PICTURE TUBES

[75] Inventors: Shinya Yoshida, Mobara; Masaaki Yamauchi, Togane, both of Japan

[73] Assignee: Hitachi, Ltd., Tokyo, Japan

[22] Filed: Aug. 22, 1975

[21] Appl. No.: 606,863

[52] U.S. Cl. ..... 313/414; 313/460
[51] Int. Cl.[2] ..... H01J 29/50
[58] Field of Search ..... 313/414, 411, 412, 409, 313/458, 460

[56] References Cited

UNITED STATES PATENTS

| | | | |
|---|---|---|---|
| 3,772,554 | 11/1973 | Hughes | 313/412 |
| 3,914,641 | 10/1975 | Standaart | 313/411 |
| 3,932,786 | 1/1976 | Campbell | 313/414 X |
| 3,936,692 | 2/1976 | Izumida et al. | 313/414 |

*Primary Examiner*—Robert Segal
*Attorney, Agent, or Firm*—Charles E. Pfund

[57] ABSTRACT

In an in-line type electron gun assembly wherein the grid electrodes of respective electron guns having the same function and constituting a main lens are formed into an integral grid structure, the grid structure is made up of two electrode members which are bonded together. The two electrode members are respectively provided with aligned three openings at corresponding positions. These openings are provided with long and short sleeves alternately such that the sum of the lengths of the long and short sleeves of the opposing openings of the first and second electrode members is equal to a predetermined length.

11 Claims, 7 Drawing Figures

IN-LINE TYPE ELECTRON GUN ASSEMBLY FOR USE IN MULTI-BEAM TYPE COLOR PICTURE TUBES

BACKGROUND OF THE INVENTION

This invention relates to an in-line type electron gun assembly utilized for an in-line multi-beam type colour picture tube and more particularly to an in-line type electron gun assembly including a plurality of grid structures in which corresponding grid electrodes of respective electron guns emanating electron beams are constructed as integral grid structures.

The in-line type colour picture tube of the class described above generally comprises a fluorescent surface 12 or screen emanating different colours (usually red, green and blue) and formed on the inner surface of the face plate 11 of a glass bulb 10 and a colour selection electrode 13 a predetermined distance spaced from the fluorescent surface. Further, in the neck portion 14 of the glass bulb is disposed an in-line type electron gun assembly 15 comprising three electron guns emanating a plurality (three) of electron beams toward the fluorescent surface 12. A deflection coil 16 and a convergence adjusting means 17 are mounted to surround the neck portion 14. The electron beams emanated from respective electron guns of the electron gun assembly are focused on one point of the colour selection electrode 13 by the action of the magnetic fields produced by the convergence adjusting means 17 and the deflecting coil 16 and then caused to impinge upon corresponding phosphor dots on the fluorescent surface.

The prior art electron gun assembly 15 of the in-line type has a construction as shown in FIG. 2 wherein the grid electrodes of respective electron guns having the same function are combined into a integral grid structure.

More particularly, as shown in FIG. 2, three cathode electrodes 22*a*, 22*b* and 22*c* are arranged side by side relationship along a line and are supported by a flat plate shaped cathode holder 21. Each cathode electrode is heated by a cathode heater 23 contained therein to emit electrons. In front of the cathode electrodes are disposed a first grid structure 24 for controlling the electron beams emanated by respective cathode electrodes, a second grid structure that accelerates the electron beams transmitting through the first grid structure, and third and fourth grid structures 26 and 27 in the form of short cylinders which are made of stainless steel, for example, and constitute an electron lens. These structures are secured to a glass bead 28 and function to cause the electron beams to impinge upon corresponding phosphor dots. The third grid structure 26 comprises upper and lower sections. Respective grid electrodes of the third and fourth grid structures 26 and 27 are also termed main lens electrodes and respectively comprise three juxtaposed circular openings 26*a*, 26*b*, 26*c* and 27*a*, 27*b* and 27*c*. The circular openings 27*a*, 27*b* and 27*c* provided for the fourth grid assembly 27 are made to have larger diameters than the circular openings 26*a*, 26*b* and 26*c* provided for the third grid assembly 26 for the purpose of focusing the electron beams transmitting through these openings on the fluorescent surface irrespective of the diameter and pitch of the circular openings, thus forming the main lens between the groups of the openings.

Auxiliary electrodes 29 and 30 in the form of cylinders are secured to respective openings for the purpose of preventing the side walls of the third and fourth grid structures 26 and 27 from affecting the electric fields formed therein.

To describe more in detail, the openings 26*a*, 26*b*, 26*c* and 27*a*, 27*b*, 27*c* are not disposed at equal distances from the side walls of the third and fourth grid structures but instead they are disposed at asymmetrical positions. Accordingly, when predetermined potentials are impressed upon these grid structures non-uniform or not concentric electric fields are formed near the openings thus forming a not point aberration which degrades the focusing characteristic. Such difficulty can be obviated by providing sleeves extending through respective grid structures from respective circular openings. Of course it is not necessary to provide such sleeves if integral sleeves or cylinders are formed to extend from the peripheries of respective openings. However, it is difficult to form three juxtaposed circular openings and integral sleeves having a desired length near the openings for flat plates which are used to form the third and fourth grid structures due to elongation of the flat plates. More particularly, the result of an experiment shows that when the length of the sleeves is made to be larger than 60% of the opening diameter it is possible to prevent the adverse effect of the side walls of respective grid structures 26 and 27 upon the electric fields near respective openings. To simultaneously form sleeves having the same length for respectively juxtaposed circular openings by a single drawing operation is extremely difficult, especially when the grid structures are made of stainless steel.

SUMMARY OF THE INVENTION

Accordingly, it is an object of this invention to provide an improved in-line type electron gun assembly having a simple construction but can prevent adverse effect of the side wall of the grid structure.

Another object of this invention is to provide an improved in-line type electron gun assembly capable of reducing the number of assembling steps.

According to this invention, there is provided an in-line type electron gun assembly wherein the grid electrodes of respective electron guns having the same function and constituting a main lens are formed into an integral grid structures, characterized in that the grid structure comprises two electrode members, that the first electrode member is provided with three aligned openings, that alternate openings are provided with long and short sleeves, that the second electrode member is also provided with three openings at positions corresponding to the three openings of the first electrode member, and that alternate openings of the second electrode member are provided with short and long sleeves such that the sum of the lengths of the long and short sleeves of the opposing openings of the first and second electrode members is equal to a predetermined length.

The opposing long and short sleeves may be welded together or may terminate with a small gap therebetween. If desired, the length of the short sleeve may be reduced to zero.

BRIEF DESCRIPTION OF THE DRAWINGS

Further objects and advantages of the invention can be more fully understood from the following detailed description taken in conjunction with the accompanying drawings in which.

DESCRIPTION OF THE PREFERRED EMBODIMENTS

Figure 1:
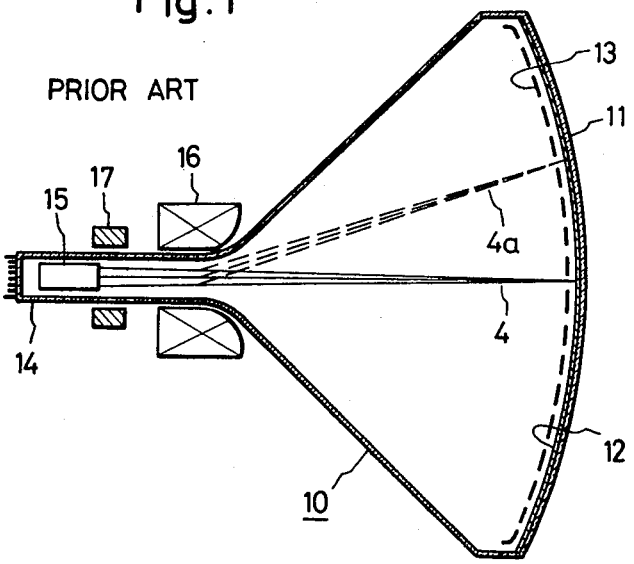
Fig. 1 PRIOR ART
FIG. 1 is a diagrammatic longitudinal sectional view showing the basic construction of an in-line type colour picture tube.
Figure 2:
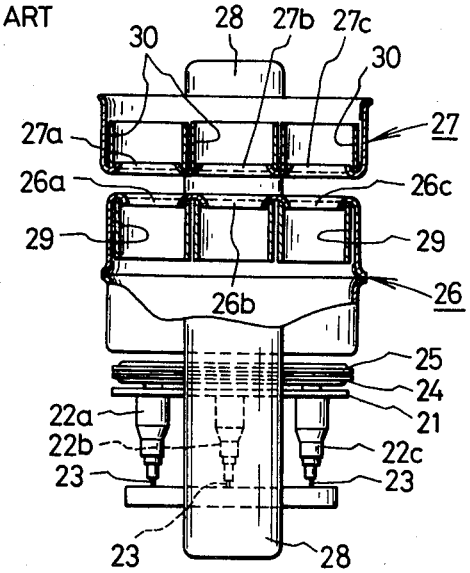
Fig. 2 PRIOR ART
FIG. 2 shows a side view, partly broken away, of a prior art in-line type electron gun assembly.
Figure 3:
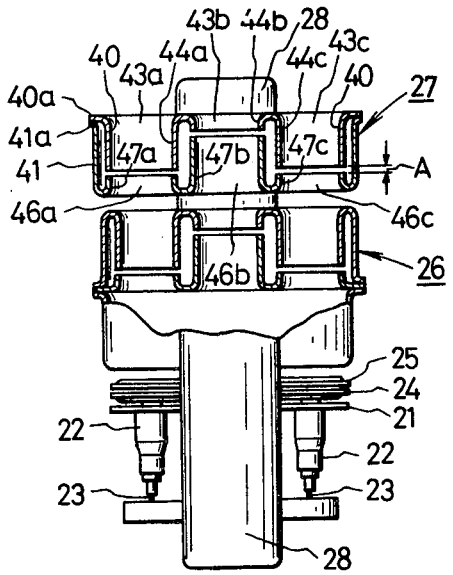
FIG. 3 is a side view, partly broken away, showing one embodiment of the in-line type electron gun assembly embodying the invention.
Figure 4:
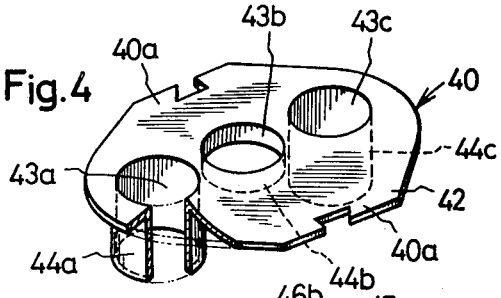
FIGS. 4 and 5 are perspective views, partly broken away, showing the construction of the fourth grid structure utilized in the electron gun assembly shown in FIG. 3 and FIGS. 6 and 7 are side views, partly broken away, of another embodiments of the in-line type electron gun assembly of this invention.
Figure 5:
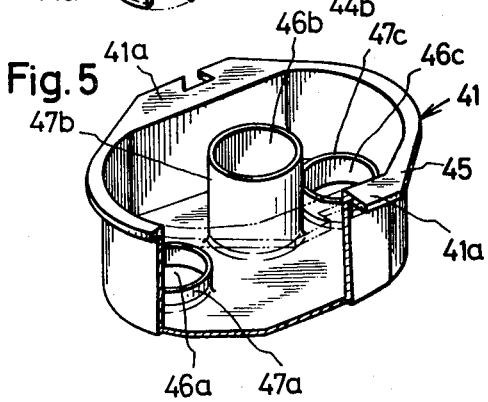

FIG. 3 shows a preferred embodiment of the novel in-line type electron gun assembly of this invention in which elements corresponding to those shown in FIG. 2 are designated by the same reference numerals. Although the following description is made with reference to only the fourth grid assembly 27 it should be understood that the same description is also applicable to the third grid electrode and other electrodes. The fourth grid structure 27 shown in FIG. 3 comprises a combination of two electrodes, that is the first and second electrodes 40 and 41 respectively formed from flat plate members. As shown in FIG. 4, the first electrode 40 is constructed such that three openings 43*a*, 43*b* and 43*c* having the same diameter are provided for an electrode member 42 along a straight line and the openings 43*a* and 43*c* on both sides of the central opening 43*b* are provided with relatively long sleeves 44*a* and 44*c* having the same diameter as those of the openings 43*a* and 43*c*, said long sleeves 44*a* and 44*c* having same length, whereas the center opening 43*b* is provided with a relatively short sleeve 44*b* having the same diameter as that of the opening 43*b*. As shown in FIG. 5, the member 45 of the second electrode 41 is formed in a cup-like configuration and the bottom thereof is provided with openings 46*a*, 46*b* and 46*c* at positions corresponding to those of the openings 43*a*, 43*b* and 43*c*. Openings 46*a* and 46*c* are provided with relatively short sleeves 47*a* and 47*c* whereas the opening 46*b* with a relatively long sleeve 47*b*. In the following description openings provided with the sleeves are termed "sleeved openings".

As shown in FIGS. 4 and 5 the sleeves of respective sleeved openings 44*a*, 44*b*, 44*c* and 47*a*, 47*b* and 47*c* project toward each other and the sum of the lengths of the opposing sleeves is made to be equal to a predetermined length. Each of the sleeved openings is formed by drawing respective members 42 and 45.

The first and second electrodes 40 and 41 constructed as above described are bonded together at their flanges to form a small gap A therebetween as shown in FIG. 3. Alternatively, the opposing sleeves may contact directly with each other. However, the presence of the gap A renders easy the assembling and working. The electrodes bonded in this manner are used as a portion of the electron gun assembly.

As can be clearly noted from the foregoing description, in the in-line type electron gun assembly embodying the invention each grid structure comprising the main lens is formed by unitary bonding together a pair of electrodes, one electrode being provided with long and short sleeved openings alternately arranged along a straight line and the other electrode being also provided with short and long sleeve openings alternately such that the sum of the lengths of opposing sleeves is equal to a predetermined length. This construction can decrease the number of component parts and the number of fabrication steps.

The length of the short sleeves may be reduced to zero in which case the sleeved opening comprises only an opening.

Figure 6:
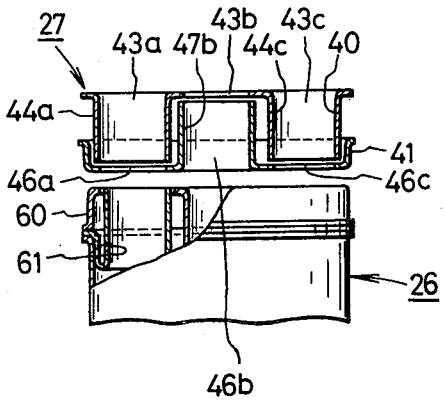

FIG. 6 shows another embodiment of this invention wherein short sleeves 44*b*, 47*a* and 47*c* of the previous embodiment are omitted. Accordingly, each sleeve extending from the first and second electrodes respectively has the predetermined length. Accordingly, the flanges of the first and second electrodes 40 and 41 of the fourth grid structure are not joined as shown in FIG. 3, but are separated. In this modification, the relative position between the two electrodes is determined by the glass bead 28. Further, the short sleeves of the third grid structure 26 are also eliminated. However, the side walls of the first and second electrodes comprising the third grid structure extend toward each other so that the flanges of both side walls are bonded together. The third grid structure 26 is supported by the flange of the second grid structure located thereunder. The relative position of the first and second electrodes of the third and fourth grid structures may be reversed. Further, also the long sleeve of the second electrode of the third grid structure 26 is shown to extend through the opening of the first electrode but the sleeve may be terminated a short distance from the opening of the first electrode as that of the fourth grid structure. With this construction the short sleeved openings comprise mere openings so that the stamping operation of the electrodes becomes simple. Of course, when eliminating the short sleeves, it becomes necessary to increase the length of the longer sleeves to the predetermined length.

Figure 7:
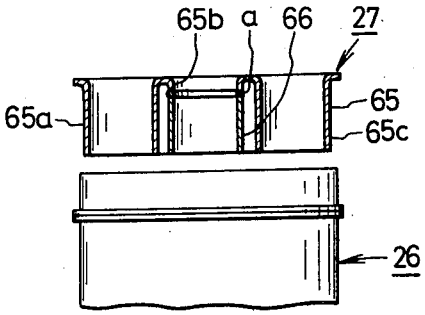

FIG. 7 illustrates still another embodiment of this invention in which the second electrode is comprised by a sleeve 66 welded at *a* to short sleeves 65*b* disposed on the inner side of the long sleeves 65*a* and 65*c* of the first electrode 65, which may have same length as the sleeves 44*a* and 44*c* shown in FIG. 6.

Although the invention has been shown and described in terms of some specific embodiments, it should be understood that the invention is not limited to these specific embodiments and that many modifications and alternations will be obvious to one skilled in the art without departing from the scope of the invention. For example, instead of constructing the first and second electrodes of each electron gun as an integral structure they may be constructed as separate units. Further, it should be understood that the invention is not limited to uni-potential type but can also be applied to bi-potential type.

What is claimed is:

1. In a in-line type electron gun assembly wherein the grid electrodes of respective electron guns having the same function and constituting a main lens are formed into integral grid structures, the improvement wherein said grid structure comprises two electrode members, the first electrode member being provided with three openings along a straight line, said openings being provided with long and short sleeves alternately, the second electrode member being also provided with three openings at positions corresponding to said three openings of said first electrode member, said openings of said second electrode member being provided with short and long sleeves alternately such that the sum of the lengths of said long and short sleeves of the opposing openings of said first and second electrode members is equal to a predetermined length.

2. The electron gun assembly according to claim 1 wherein the central opening of the first electrode member is provided with a short sleeve, the openings on both sides of said central opening are provided with long sleeves, the central opening of the second electrode member is provided with a long sleeve, the openings on both sides of the last mentioned central opening are provided with short sleeves, and the long sleeves of said first electrode member have same length.

3. The electron gun assembly according to claim 2 wherein said first electrode member comprises a plate member and said second electrode member is formed in a cup-like configuration and all the openings with sleeves are standing therein.

4. The electron gun assembly according to claim 3 wherein the side walls of the second electrode member are formed with flanges at their free ends and the first electrode member is bonded to said second electrode member at said flanges.

5. The electrode gun assembly according to claim 2 wherein the length of said short sleeves is zero.

6. The electron gun assembly according to claim 2 wherein the opposing ends of said long and short sleeves are spaced a predetermined distance.

7. The electron gun assembly according to claim 1 wherein the central opening of the first electrode member is provided with a short sleeve, the openings on both sides of said central opening are provided with long sleeves, the central opening of the second electrode member is provided with a long sleeve, the openings on both sides of the last mentioned central opening are provided with short sleeves, and all of said sleeves have same inner diameter.

8. The electron gun assembly according to claim 1 wherein said first electrode member comprises a plate member provided with three aligned openings, the central opening is provided with a short sleeve, the two openings on both sides of the central opening are provided with long sleeves extending in the same direction as said short sleeve, the second electrode member comprises a cup shaped member, the bottom thereof is provided with three aligned openings at positions corresponding to the openings of the first electrode member, the central opening of said bottom is provided with a long sleeve, and the two openings on both sides of the central opening of said bottom are provided with short sleeves.

9. The electron gun assembly according to claim 7 wherein the grid structures juxtaposed along the axis of the electron gun assembly to form a main lens are disposed such that the openings of the second electrode members of respective grid structures oppose each other.

10. The electron gun assembly according to claim 1 wherein the central opening of the first electrode member is provided with a short sleeve, the two openings on both sides of the central opening are provided with long sleeves, the central opening of the second electrode member is provided with a long sleeve, and the short and long sleeves of the central openings of the first and second electrode members have the same diameter and are welded together to form a composite sleeve having the same length as the long sleeves of the first electrode member.

11. In an in-line type electron gun assembly of the type comprising three electron guns each including a cathode electrode containing a heater, first, second, third and fourth grid electrodes, at least the third and fourth grid electrodes including grid structures each made up of first and second electrode members having the same function, the improvement wherein said first electrode member is provided with three aligned openings, said openings being provided with long and short sleeves alternately, the second electrode member is also provided with three aligned openings at positions corresponding to the openings of said first electrode member, said openings of said second electrode member are provided with short and long sleeves alternately such that the sum of the lengths of the long and short sleeves of the opposing openings of said first and second electrode members is equal to a predetermined length.

* * * * *